US007530852B2

(12) United States Patent
Hu et al.

(10) Patent No.: US 7,530,852 B2
(45) Date of Patent: May 12, 2009

(54) ELECTRICAL CARD CONNECTOR

(75) Inventors: Yong-Hui Hu, ShenZhen (CN); Lie-Yi Hu, ShenZhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/011,177

(22) Filed: Jan. 23, 2008

(65) Prior Publication Data

US 2008/0176440 A1 Jul. 24, 2008

(51) Int. Cl.
*H01R 24/00* (2006.01)

(52) U.S. Cl. ..... 439/630

(58) Field of Classification Search ..... 439/630, 439/541.5, 159, 188

See application file for complete search history.

(56) References Cited

U.S. PATENT DOCUMENTS

| | | | | |
|---|---|---|---|---|
| 6,386,920 | B1 * | 5/2002 | Sun | 439/630 |
| 7,063,571 | B2 * | 6/2006 | Yu | 439/630 |
| 7,267,565 | B2 * | 9/2007 | Hsu et al. | 439/159 |

* cited by examiner

*Primary Examiner*—Phuong K Dinh
(74) *Attorney, Agent, or Firm*—Wei Te Chung

(57) ABSTRACT

An electrical card connector for receiving a first card and a second card comprises a first insulating housing and a second insulating housing. The first housing defines a bottom surface, a concave portion formed from the bottom surface of the first housing upwardly and having a pair of walls. The second housing has two opposite second sidewalls. Either the walls of the first housing or the sidewalls of the second housing have notches, while the other ones have corresponding latches for engaging with the notches, and the second housing is assembled onto the first housing forming a receiving slot for receiving the second card.

14 Claims, 6 Drawing Sheets

ELECTRICAL CARD CONNECTOR

BACKGROUND OF THE INVENTION

1. Field of the Invention

The present invention is generally related to a card connector, and more particularly to a card connector which is configured to electrically connect a SIM card and a memory card simultaneously.

2. Description of Related Art

IC (integrated circuit) cards are known in the art and contain intelligence in the art and contain intelligence in the form of a memory circuit or other electronic program. A card reader is used to read the information or access the memory stored on the card. IC cards are used in countless applications today, including video cameras, smart-phones, music players, ATMs, cable television decoders, toys, games, pc adapters and other electronic applications.

IC card is electrically connected to the PCB (printed circuit board) of electrical product by an electrical connector. Sometimes, the electrical product not only needs a SIM (subscriber identify module) card, but also needs a memory card to store enormous digital information.

An electrical card connector of the related art used to connect a SIM card and a memory card to corresponding circuit, includes a first card connector and a second card connector. The first connector is mounted above the second connector. The first connector comprises a first insulating housing, a plurality contacts received in the first housing, and a first metal shield covering the top and the sides of the first housing. The second connector comprises a second insulating housing, a plurality contacts received in the second housing, and a second metal shield covering the top and sides of the second housing. The first housing defines an assembling portion from the bottom thereof, and the second shield mounts onto the corresponding assembling portion, the second connector and the first connector are jointed accordingly.

One problem of this type connector is that the manufacture program of the card connector is complicated. Another problem is that the size of the element tends to miniaturization along the development of the electrical element.

Hence, an improved card connector is highly desired to overcome the aforementioned disadvantages of the prior art.

SUMMARY OF THE INVENTION

Accordingly, an object of the present invention is to provide a card connector which economizes manufacture program and further decreases the size of the card connector in accordance with the development trend of the electronic component.

To achieve the above object, an electrical card connector for receiving a first card and a second card comprises a first insulating housing and a second insulating housing. The first housing defines a bottom surface, a concave portion formed from the bottom surface of the first housing upwardly and having a pair of walls. The second housing has two opposite second sidewalls. Either the walls of the first housing or the sidewalls of the second housing have notches, while the other ones have corresponding latches for engaging with the notches, and the second housing is assembled onto the first housing forming a receiving slot for receiving the second card.

Other objects, advantages and novel features of the present invention will be drawn from the following detailed description of a preferred embodiment of the present invention with attached drawings.

DETAILED DESCRIPTION OF THE INVENTION

Reference will now be made in detail to the preferred embodiment of the present invention.

Referring to FIGS. 1-6, the card connector 100 in accordance with the present invention is adapted for receiving a first card 90 and a second card 91. The card connector 100 comprises a first card connector (not labeled) and a second card connector (not labeled).

Figure 1:
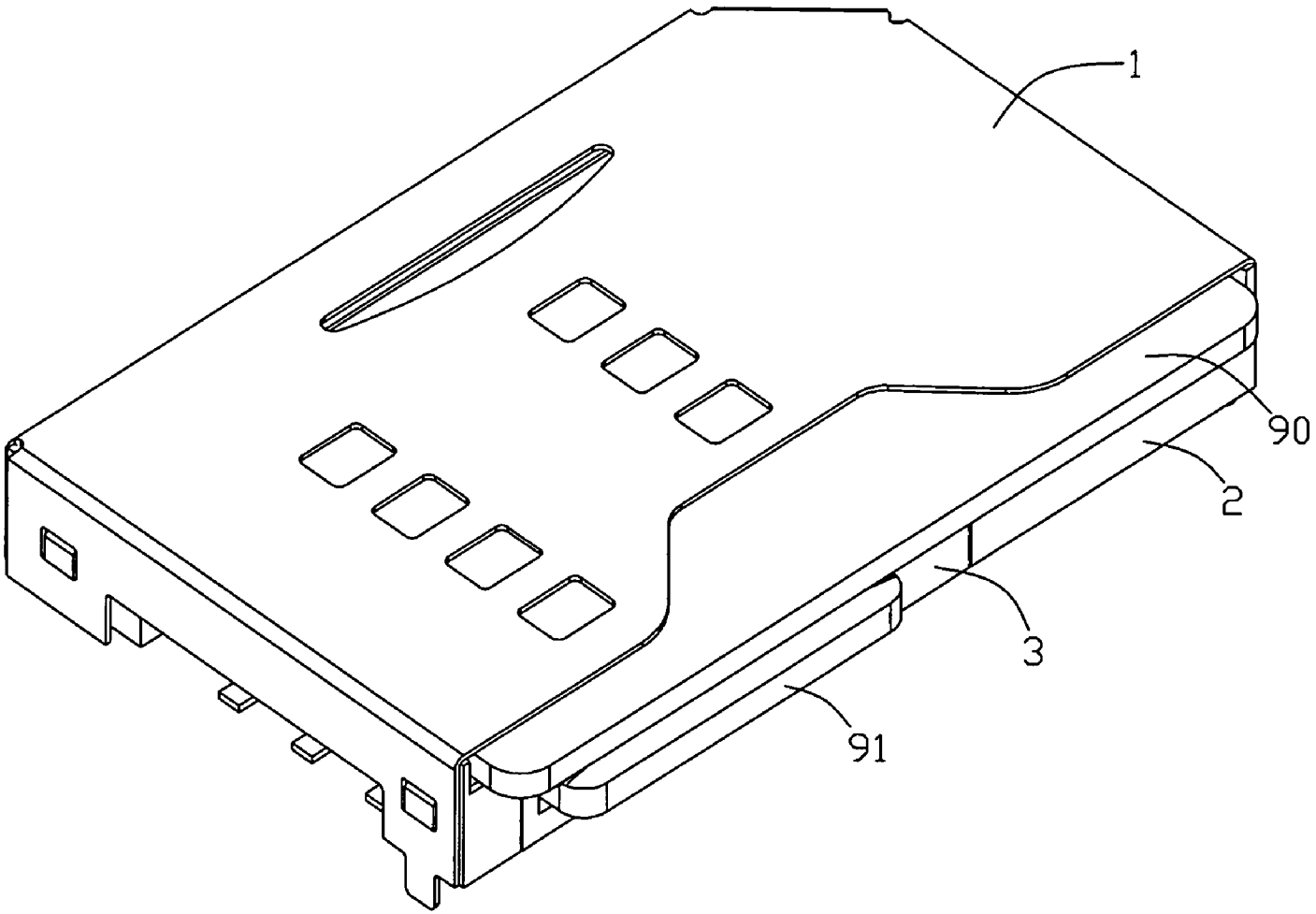
FIG. 1 is an assembled, perspective view of a card connector in accordance with the present invention with a SIM card and a memory card accommodated therein.
Figure 2:
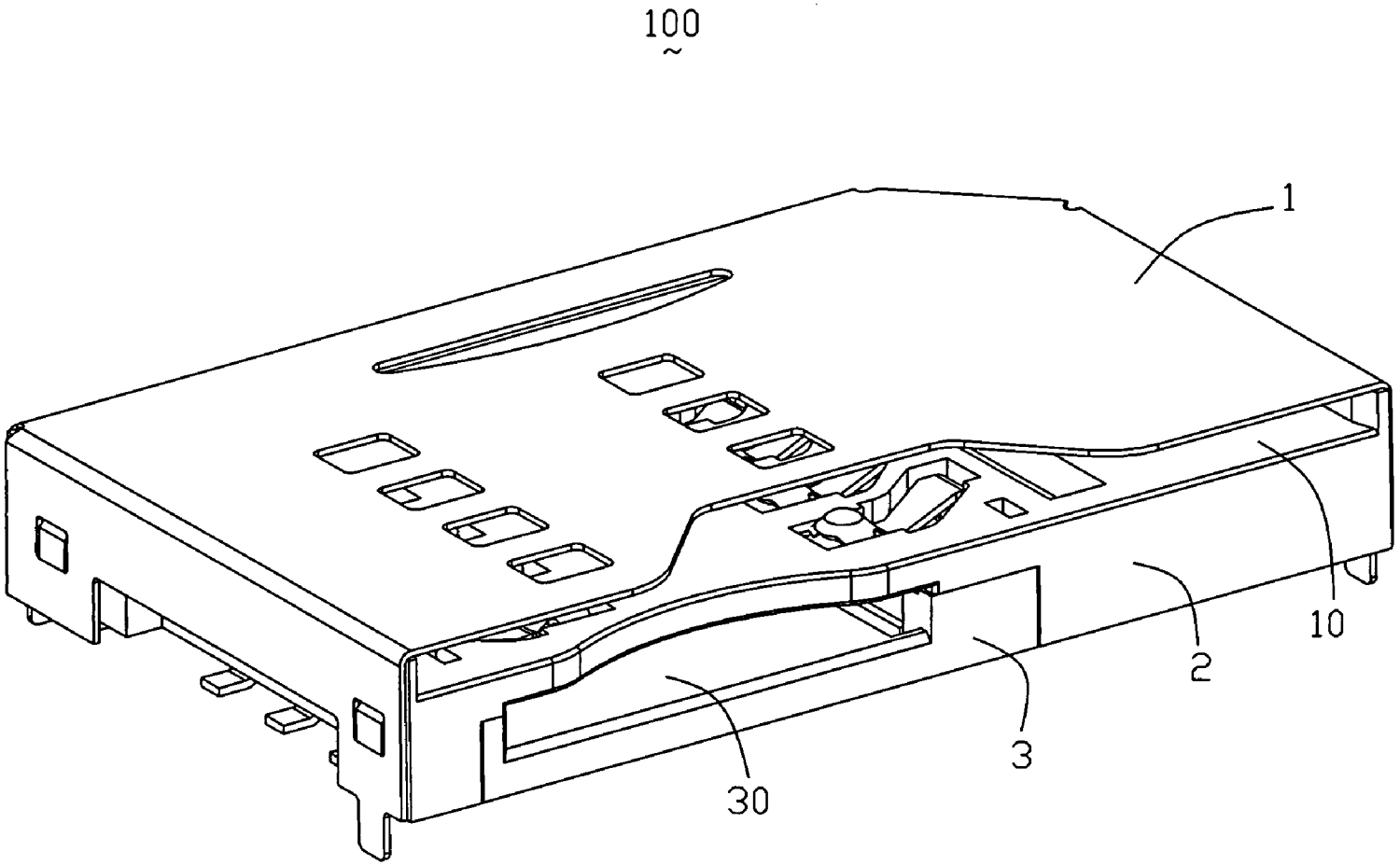
FIG. 2 is a perspective view of the card connector of FIG. 1.
Figure 3:
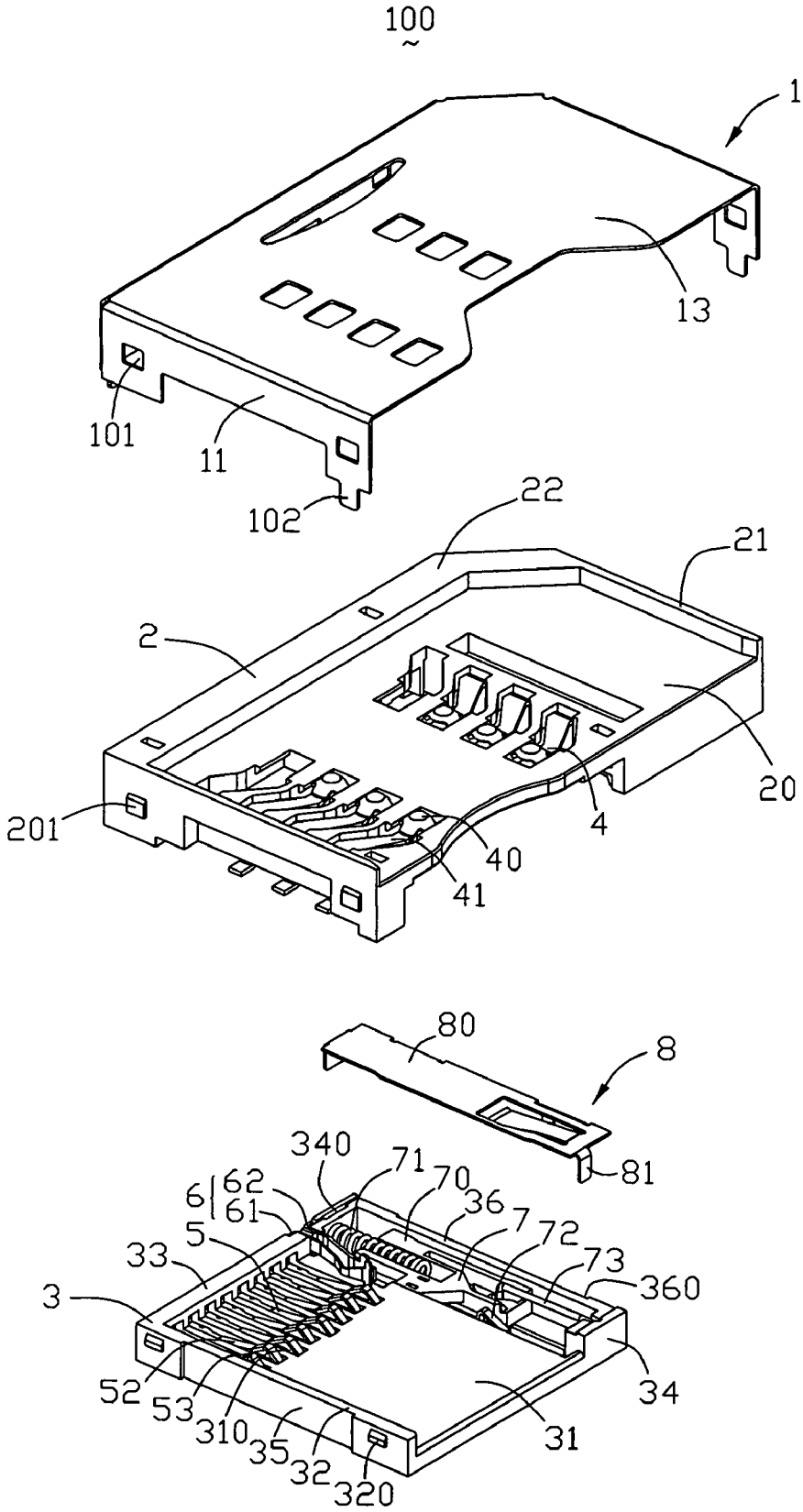
FIG. 3 is an exploded, perspective view of the card connector of FIG. 2.
Figure 4:
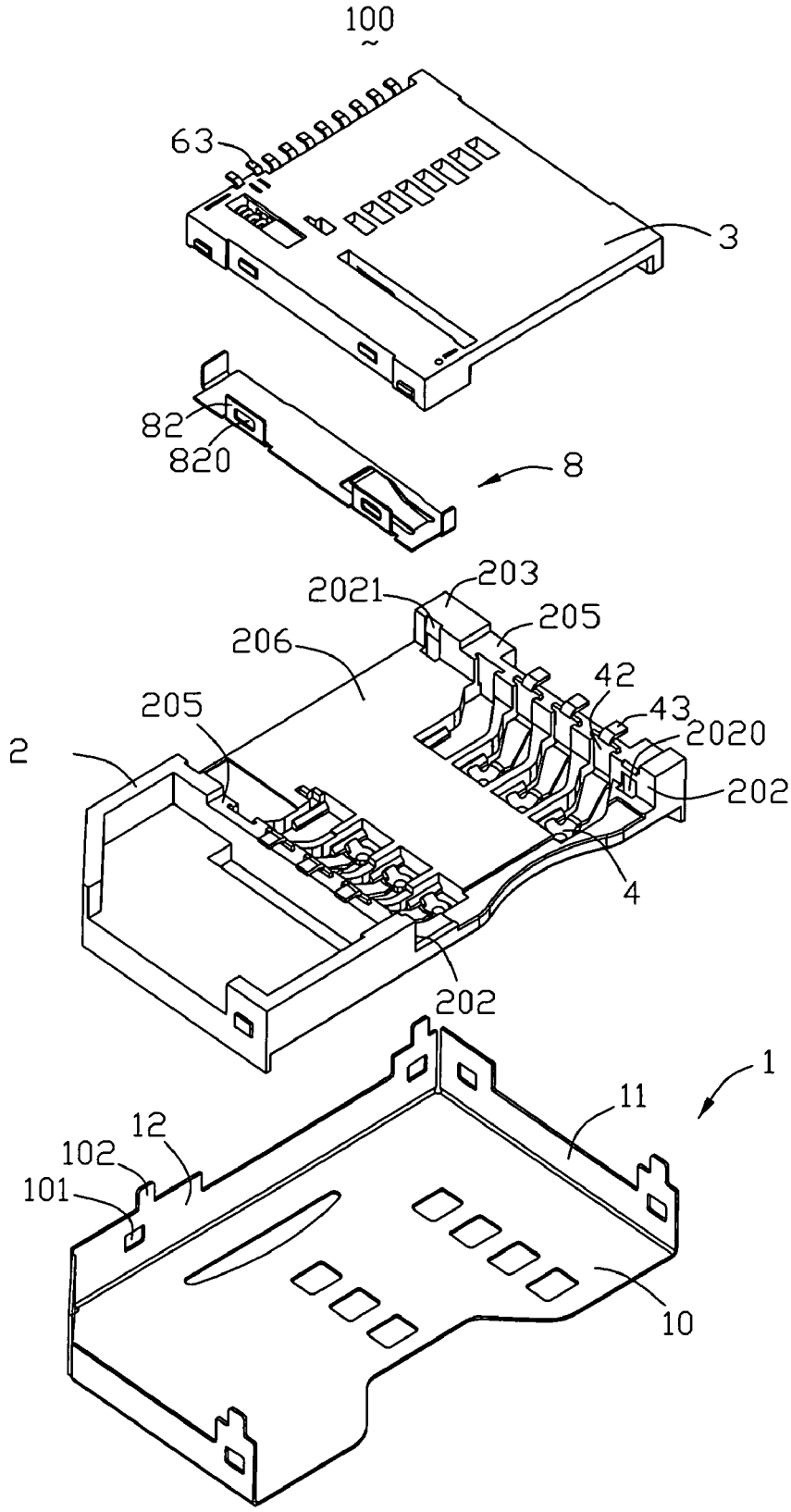
FIG. 4 is another exploded, perspective view of the card connector of FIG. 2.
Figure 5:
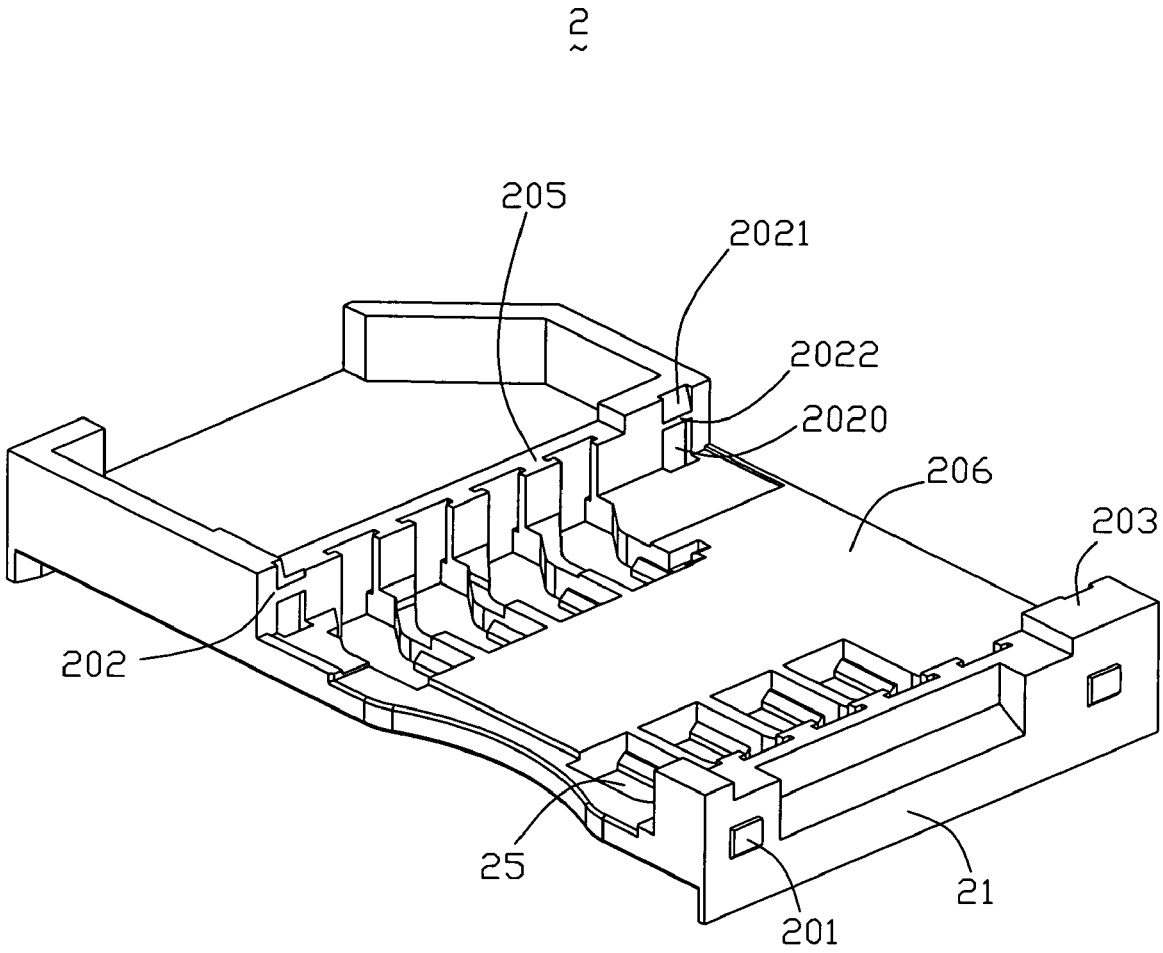
FIG. 5 is a perspective view of the housing of the card connector of the FIG. 2.
Figure 6:
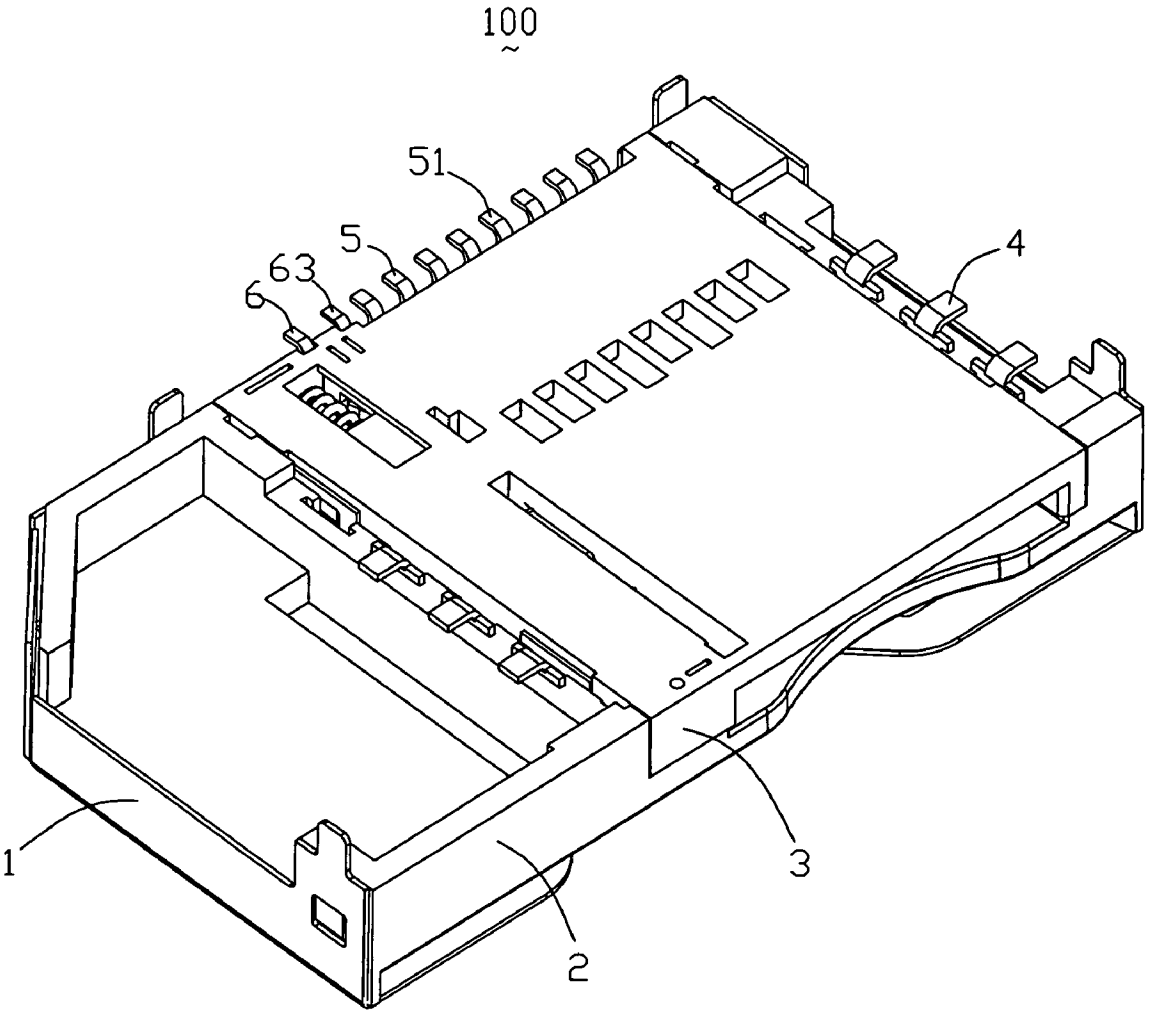
FIG. 6 is another perspective view of the card connector of FIG. 2.

Referring to FIG. 3, the first card connector includes a first insulating housing 2, a plurality of first contacts 4 received in the first housing 2, and a first metal shell 1 shielding the first housing 2.

The first housing 2 is generally approximately frame configuration. The first housing 2 comprises a first base 20, a pair of opposite first sidewalls 21 and a first rear wall 22 extending upwardly from lateral side of the first base 20, which commonly define a first card receiving space 10 for accommodating the first card 90. The first base 20 defines two rows of first grooves 25 for fastening and receiving first contacts 4. Several projects 201 are arranged on outer surfaces of the first sidewalls 21 and the rear wall 22 respectively. A concave portion 206 is formed from the bottom surface 203 of the first housing 2 upwardly. The concave portion 206 has a pair of walls 202. Each wall 202 has a pair of notches 2020 at the opposite end, a leading portion 2021 having a chamfer communicating with the bottom surface 203, and a raised portion 2022 between the notch 2020 and the leading portion 2021 for assembling the second card connector onto the first card connector conveniently and firmly. A hollow portion 205 is defined in the bottom surface 203 of the first base 20 communicating with the concave portion 206 between the two notches 2020.

The first contact 4 comprises a first fastening portion 42 engaging with the first base 20, a first soldering portion 43 extending perpendicularly from an end of the first fastening portion 42 received in the hollow portion 205 of the first housing 2, a first resilient portion 41 extending from the other end of the first fastening portion 42 opposite to the first soldering portion 43 received in the first grooves 25 of the first housing 2, and a first contacting portion 40 extending upwardly from the free end of the first resilient portion 41 protruding in the receiving space 10.

The shell 1 is made of metal to cover the housing. The shell 1 comprises a top cover 13, a pair of opposite side portions 11 and a rear portion 12 extending downwardly from lateral sides of the top cover 13. Several openings 101 are formed on the two side portions 11 and the rear portion 12 engaging with the projects 201 of the first housing 2. A plurality of soldering tabs 102 extending from the bottom of the side portions 11 and the rear portion 12 for soldering the shell 1 onto the printed circuit board (not shown) prevented from electro magnetic interference.

The second card connector is assembled to the concave portion 206 of the first housing 2 together define a second card receiving space 30 for receiving the second card 91.

The second card connector comprises a second insulating housing 3, a plurality of second contacts 5, a detect switch 6 positioned on one end of the second housing 3, a rejecting mechanism 7 mounted on one side of the second housing 3, and a metal sheet 8 covering the rejecting mechanism 7 and mounted on the second housing 3.

The second housing 3 includes a second base 31, a pair of second sidewalls 32 extending upwardly from the opposite lateral sides of the second base 31, a second rear wall 33 connecting the two second sidewalls 32. The second sidewalls 32 includes a left wall 35 and a right wall 36. The right wall 36 is formed with a front wall 34 at front end thereof. A plurality of second grooves 310 are defined on the second base 31 and extending through the second rear wall 33. A pair of fastening slots (not labeled) extends from the top surface of the second rear wall 33 adjacent to the second groove 310. A pair of third grooves 340 are defined on the front wall 34 and the corresponding position of the second rear wall 33. An elongated groove (not shown) is formed on the right wall 36 adjacent to the front wall 34 communicating with the second receiving space 30 along the card insertion direction for accommodating the ejector mechanism 7. Each second sidewalls 32 has a pair of latches 320 corresponding to the notches 2020 of the first housing 2 for assembling the second connector to the first connector. A cutout 360 extends inwardly from the center of the outer surface of the right wall 36. Several protrusions (not shown) are formed on the flat surface of the cutout 360.

The second contact 5 comprises a second fastening portion (not shown) positioned in the second rear wall 33 of the second housing 3, a second soldering portion 51 extending from one end of the second fastening portion outwardly and downwardly, a second resilient portion 52 extending from the other end of the second fastening portion opposite to the second soldering portion 51 received in the second groove 310 of the second housing 3, a second contacting portion 53 extending upwardly from the free end of the second resilient portion 52 protruding in the second receiving space 30.

The detect switch 6 comprises a pair of third contacts 61, 62. Each third contact 61, 62 comprises a third soldering portion 63, a third resilient portion (not labeled) protruding into the second receiving space 30, a third fastening portion (not shown) connecting the third soldering portion and the third fastening portion positioned in the second rear wall 33. The two third resilient portion are separated without the second card inserting into the receiving slot, and when the second card inserting into the receiving slot, the two third resilient portion contact.

The ejector mechanism 7 positioned in the elongated groove of the second housing 2, comprises a slider 70, a spring 71, a blocking member 72, a cam follower 73, a restricting member (not shown) protruding from the second rear wall 33, and a locking hole (not shown) formed from the top of the front wall 34. The slider 70 is rectangle approximately. An assembling cutout (not labeled) is formed on one end of the slider 70, and a heart-shaped leading groove (not labeled) extends from the upper surface of the other end of the slider 7. A wedge-shaped sustaining portion (not labeled) protrudes from one side of the slider and extends into the second receiving space 30. One end of the spring 71 assembles onto the restricting member, and the other end of the spring 71 assembles in the assembling cutout of the slider. One end of the cam follower 73 is positioned in the locking hole, while the other end of the cam follower is positioned in the heart-shaped leading groove; and the cam follower 73 operatively associated between the slider 70 and the second housing 3 for latching the slider 70 in a latched position. The blocking member 72 assembles on the underside of the sustaining portion of the slider 70, and a locking portion (not shown) of the locking member 72 protrudes into the second receiving space 30 for locking the second card 91 in the second receiving space 30 together with the sustaining portion.

The metal sheet 8 covers the ejector mechanism 7 and is assembled onto the second housing 3. The sheet 8 includes a flat portion 80, a pair of fastening patches 81 respectively extending from the two opposite end of the flat portion 80 perpendicularly and fastened in the third grooves 340, a pair of fastening patches 81 extending from one side of the flat portion 80 perpendicularly respectively defining a cavity 820 for engaging with the protrusions of the second housing 3.

The first soldering portion 43, the second soldering portion 51, and the third soldering portion 63 of the card connector are coplanar.

The present card connector 100 takes advantage of the first housing 2 as the cover of the second card connector together defining the second receiving space 30 for receiving the second card 91, and compares to the related art economizing manufacture program of the card connector, and further decreasing the size of the card connector in accordance with the development trend of the electronic component.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. An electrical card connector for receiving a first card and a second card comprising:

a first insulating housing including a base defining a bottom surface;

peripheral walls extending upward from the base to define sidewalls and the rear wall;

a cover attached to above walls of the housing and having a top plate jointly define a first receiving space above the base for receiving a first card;

a second insulating housing having two opposite second sidewalls;

a concave portion formed from the bottom surface of the first housing upwardly and having a pair of walls; and either the walls of the first housing or the second sidewalls of the second housing having notches, while the other ones having corresponding latches for engaging with notches, and the second housing assembled onto the first housing forming a receiving slot for receiving the second card, wherein each wall of the first housing has a pair of notches at the opposite end, a leading portion having a chamfer communicating with the bottom surface, and a raised portion between the notch and the leading portion.

2. The electrical card connector as described in claim 1, wherein said notch is formed on the wall of the first housing, said latch is formed on the corresponding position of the second sidewalk of the second housing.

3. The electrical card connector as described in claim 1, wherein the connector further comprises a plurality of contacts mounted in the first housing and a plurality of second contacts mounted in the second housing; the cover, the first housing, and the first contacts form a first connector; the first housing, the second housing and the second contacts form a second connector.

4. The electrical card connector as described in claim 3, wherein the second connector further comprises a detect switch having a pair of third contacts, and each third contact has a third resilient portion separate from the other when the second card is not inserted into the receiving slot, when the second card is inserted into the receiving slot, the two resilient portions contact.

5. The electrical card connector as described in claim 3, wherein the second connector further having an ejector mechanism mounted on one side of the second housing.

6. The electrical card connector as described in claim 5, wherein the second connector further having a metal shell mounting the ejector mechanism onto the second housing.

7. An electrical connector, comprising:

an insulative housing including a partition defining an upper receiving space for receiving a first mating connector;

a pair of standoff walls spaced apart from each and each defining a plurality of retaining slots therein and in communication with a plurality of passageways defined in the partition;

a plurality of first set of contact terminals each having a base portion positioned in the corresponding retaining slot, and having a mating portion extending into the passageway and into the upper receiving space;

a sub-housing disposed between the standoff walls, and having a plurality of second sets contact terminals assembled therein, the sub-housing including a mating interface defining a second receiving space with the partition for receiving a second mating connector which is different to the first mating connector; and a metal shield attached to the housing from atop to substantially surrounding the housing to provide shield thereof.

8. The electrical connecter as recited in claim 7, wherein a rejecting mechanism is associated with the sub-housing.

9. The electrical connector as recited in claim 7, wherein a longitudinal direction of the first set of contact terminal is orthogonal to a longitudinal direction of the second contact terminal.

10. The electrical connector as recited in claim 9, wherein an insertion direction of the second mating connector is in align with the longitudinal direction.

11. The electrical connector as recited in claim 7, wherein each of the standoff wall is defined with an undercut in which a mounting portion of the first set of contact terminal resides.

12. The electrical connector as recited in claim 7, wherein the metal shield defines a finger notch for easy removal of the first mated connector received in the upper receiving space.

13. The electrical connector as recited in claim 7, wherein the partition defines a finger notch for easy removal the second mating connector received in the second receiving space.

14. A shielded electrical connector, comprising:

an insulative housing including a supporting bracket with a pair of standoff extending downward;

peripheral walls extending upward from the supporting bracket to define sidewalls and the rear wall;

a plurality of contacting terminals securely positioned in the standoff and with contact engaging portion extending above the supporting bracket;

a metal shield attached to the housing and having a top plate jointly define a receiving space above the supporting bracket for receiving a that mating connector; and a sub-connector received under the supporting bracket for receiving a second connector which is different to the first mating connector.

* * * * *